US010323564B2

(12) United States Patent
Gonze et al.

(10) Patent No.: US 10,323,564 B2
(45) Date of Patent: Jun. 18, 2019

(54) SYSTEMS AND METHODS FOR INCREASING TEMPERATURE OF AN INTERNAL COMBUSTION ENGINE DURING A COLD START INCLUDING LOW COOLANT FLOW RATES DURING A STARTUP PERIOD

(71) Applicant: GM Global Technology Operations LLC, Detroit, MI (US)

(72) Inventors: Eugene V. Gonze, Pickney, MI (US); Mario Reichenback, Wiesbaden (DE); Sergio Quelhas, Ann Arbor, MI (US); Torsten Mueller, Russelsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 341 days.

(21) Appl. No.: 15/000,254

(22) Filed: Jan. 19, 2016

(65) Prior Publication Data

US 2017/0204774 A1 Jul. 20, 2017

(51) Int. Cl.

| | |
|---|---|
| ***F01P 7/16*** | (2006.01) |
| ***F01P 3/20*** | (2006.01) |
| ***F01P 5/10*** | (2006.01) |
| ***F02D 41/06*** | (2006.01) |
| *F01P 7/14* | (2006.01) |

(52) U.S. Cl.

CPC ..... *F01P 7/16* (2013.01); *F01P 3/20* (2013.01); *F01P 5/10* (2013.01); *F01P 7/164* (2013.01); *F02D 41/064* (2013.01); *F01P 2007/146* (2013.01); *F01P 2025/46* (2013.01); *F01P 2025/62* (2013.01); *F01P 2037/02* (2013.01)

(58) Field of Classification Search

CPC ..... F01P 7/16; F01P 3/20; F01P 5/10; F01P 7/64; F01P 7/167; F01P 2007/146; F01P 2025/46; F01P 2025/62; F02D 41/064

USPC ..... 123/41.08, 41.05

See application file for complete search history.

(56) References Cited

U.S. PATENT DOCUMENTS

| | | | | |
|---|---|---|---|---|
| 2007/0100534 | A1* | 5/2007 | Katsumata | F02D 35/023 701/103 |
| 2012/0059566 | A1* | 3/2012 | Tsunooka | F01N 5/02 701/102 |
| 2012/0232771 | A1* | 9/2012 | O'Hear | F02D 41/10 701/103 |
| 2013/0186351 | A1* | 7/2013 | Quix | F01P 5/10 123/41.02 |

(Continued)

*Primary Examiner* — Syed O Hasan

(57) ABSTRACT

A system including startup, load, flow, and peak estimation modules. The startup module, during a startup period or in response to a startup of the engine, receives a temperature signal and generates a first condition signal. The load module determines a load on the engine and generates a second condition signal. The flow module, if the first condition signal indicates a temperature of the engine is less than a first predetermined temperature and if the second condition signal indicates the load is less than a predetermined threshold, operates a pump to circulate coolant during the startup period. The peak estimation module estimates a temperature of a hottest metal location on the engine. The flow module increases a speed of the pump if the temperature of the hottest metal location is greater than a second predetermined temperature or the load is greater than or equal to the predetermined threshold.

20 Claims, 6 Drawing Sheets

(56) References Cited

U.S. PATENT DOCUMENTS

| | | | | |
|---|---|---|---|---|
| 2014/0212267 | A1* | 7/2014 | Pawellek | F01P 7/161<br>415/26 |
| 2014/0245975 | A1* | 9/2014 | Quix | F01P 5/10<br>123/41.08 |

* cited by examiner

SYSTEMS AND METHODS FOR INCREASING TEMPERATURE OF AN INTERNAL COMBUSTION ENGINE DURING A COLD START INCLUDING LOW COOLANT FLOW RATES DURING A STARTUP PERIOD

FIELD

The present disclosure relates to cooling systems for internal combustion engines, and more particularly to systems for increasing temperatures of an engine during startup.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to drive pistons and produce drive torque. Subsequent to startup and when a temperature of the engine is greater than a first threshold, coolant is circulated through one or more cylinder heads of the engine and an engine block and may also be circulated through an integrated exhaust manifold. The coolant is circulated to prevent the temperature of the engine from exceeding a second threshold. The temperature and/or flow rate of the coolant may be adjusted to control cooling of the engine, engine block, and integrated exhaust manifold and/or maintain predetermined temperatures of the engine, engine block and integrated exhaust manifold. The predetermined temperatures may be (i) greater than the first threshold, (ii) less than the second threshold, and (iii) maintained to maximize fuel efficiency of the engine.

SUMMARY

A system is provided and includes a startup module, a load module, a flow module, and a peak estimation module. The startup module is configured to (i) during a startup period of an engine or in response to a startup of the engine, receive a temperature signal from a first temperature sensor, and (ii) generate a first condition signal based on the temperature signal. The load module is configured to (i) determine a load on the engine, and (ii) generate a second condition signal. The flow module is configured to, if the first condition signal indicates a temperature of the engine is less than a first predetermined temperature, and if the second condition signal indicates the load is less than a predetermined threshold, operate a pump to circulate coolant during the startup period of the engine. The peak estimation module is configured to estimate a temperature of a hottest metal location on the engine. The flow module is configured to increase a speed of the pump if (i) the temperature of the hottest metal location is greater than a second predetermined temperature, or (ii) the load is greater than or equal to the predetermined threshold.

In other features, a system is provided and includes a startup module, a load module, a flow module and a peak estimation module. The startup module is configured to (i) during a startup period of an engine or in response to a startup of the engine, receive a temperature signal from a first temperature sensor, and (ii) generate a first condition signal based on the temperature signal. The load module is configured to (i) determine an amount of output torque of on the engine, and (ii) generate a second condition signal. The flow module is configured to, if the first condition signal indicates a temperature of the engine is less than a first predetermined temperature, and if the second condition signal indicates the amount of output torque is less than a predetermined threshold, operate a pump to circulate coolant during the startup period of the engine. The peak estimation module is configured to estimate a temperature of a hottest metal location on the engine. The flow module is configured to increase a speed of the pump if (i) the temperature of the hottest metal location is greater than a second predetermined temperature, or (ii) the amount of output torque is greater than or equal to the predetermined threshold.

In other features, a method is provided and includes: during a startup period of an engine or in response to a startup of the engine, receive a temperature signal from a first temperature sensor and generate a first condition signal based on the temperature signal; determining a load on the engine and generating a second condition signal based on the load; if the first condition signal indicates a temperature of the engine is less than a first predetermined temperature, and if the second condition signal indicates the load is less than a predetermined threshold, operating a pump to circulate coolant during the startup period of the engine; estimating a temperature of a hottest metal location on the engine; and increasing a speed of the pump if (i) the temperature of the hottest metal location is greater than a second predetermined temperature, or (ii) the load is greater than or equal to the predetermined threshold.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

During a cold start of an engine, coolant in the engine may be prevented from flowing (referred to as 'zero coolant flow') to allow the engine to warmup quickly. Zero coolant flow algorithms including temperature prediction models can be used to estimate temperatures of the engine. The zero coolant flow algorithms can be difficult to implement and can require a significant amount of calibration time and effort. For example, the temperature prediction models may be based on engine power, startup temperatures, catalyst warming states, and intake air temperatures and may be created to predict temperatures of the engine. Inaccuracies in these prediction models can result in coolant boiling and possible engine erosion.

Figure 1:
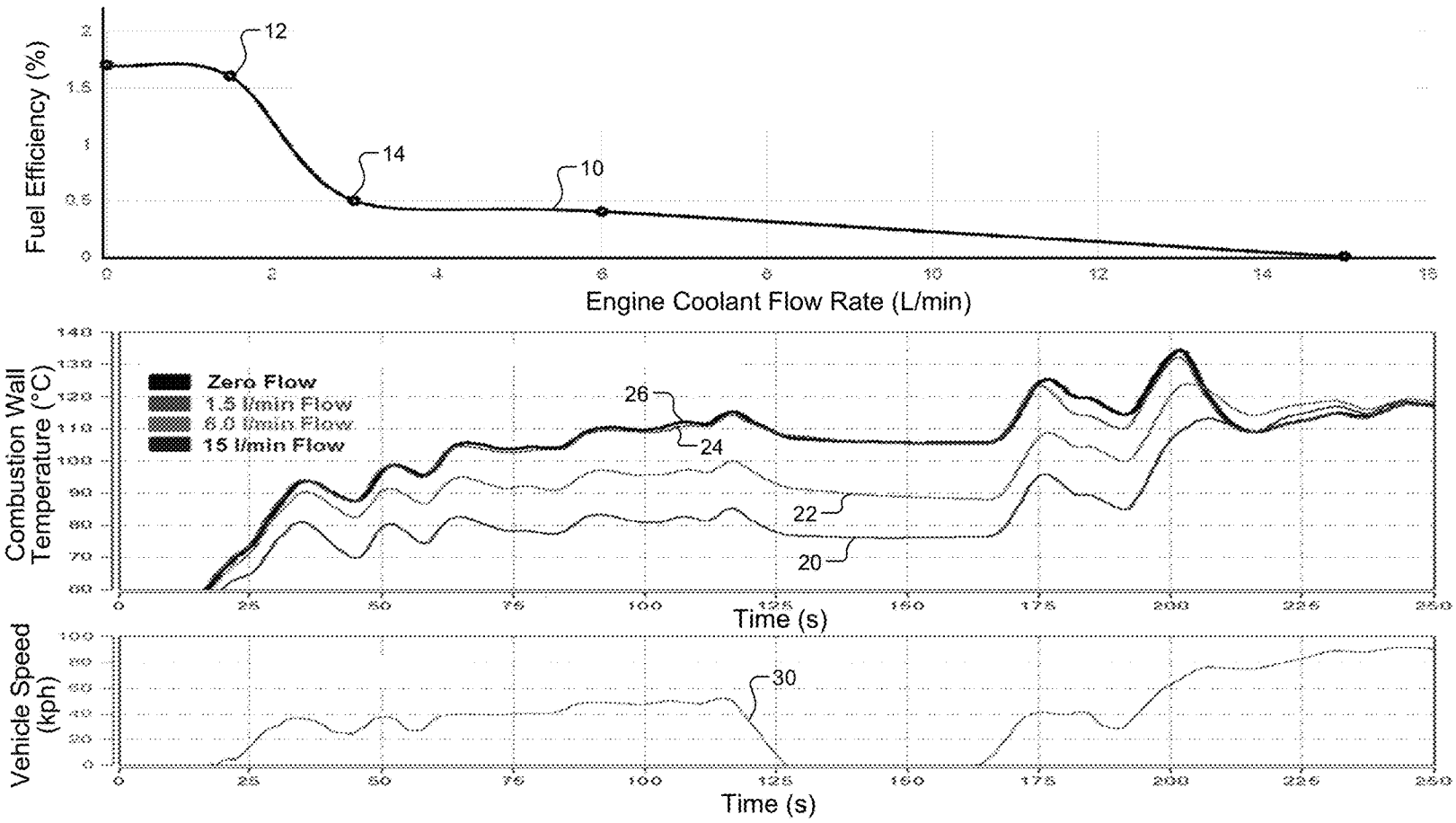
FIG. 1 is a view of multiple plots illustrating a reduction in fuel efficiency as a result of increased coolant flow rate and corresponding parameters.

Coolant flow rates and temperatures of an engine including temperatures of coolant flowing through an engine can vary during operation of the engine. This variation can affect fuel efficiency of the engine. As an example, during a cold startup of an engine when a temperature of the engine is less than a predetermined temperature, as coolant flow is increased, fuel efficiency decreases. This is illustrated by the plots of FIG. 1. FIG. 1 shows a fuel efficiency versus engine coolant flow rate plot (or first plot), a combustion wall temperature versus time plot (or second plot), and a vehicle speed versus time plot (or third plot). The first plot, the second plot and the third plot are related and associated with the same example application.

The first plot includes a fuel efficiency versus engine coolant flow rate curve 10 illustrating that as a coolant flow rate increases, fuel efficiency decreases. The first plot also shows that when the flow rate is greater than a cutoff (or transition) point, the fuel efficiency substantially decreases. This is shown by the drop in fuel efficiency between points 12, 14. Systems and methods are disclosed below that maintain coolant flow rates between zero and a predetermined flow rate (e.g., a flow rate less than or equal to 2 liters per minute (L/min) for the application associated with the first plot) during and/or after a startup of an engine. The second plot shows combustion wall temperature curves 20, 22, 24, 26 for different flow rates. The curves 20, 22, 24, 26 collectively illustrate as flow rates increase, combustion wall temperatures of the engine decrease. In the example shown, the curves 20, 22, 24, 26 correspond to the flow rates respectively of 15 L/min, 6.0 L/min, 1.5 L/min, and 0 L/min. The third plot includes a vehicle speed versus time curve 30 showing that changes in vehicle speed can be related to, proportional to and/or similar to changes in combustion wall temperature.

Systems and methods are disclosed herein for controlling the temperature of coolant in an engine during and/or after startup of the engine. This includes restricting and/or providing a minimum flow rate during and/or after a startup (referred to as the 'warm-up period' or 'cold startup period'). This increases warm-up rates of the engine while maintaining high fuel efficiency during the warm-up period. Coolant is past at a slow rate across hot spots in an engine during the warm-up period without removing excessive thermal energy. Feedback control is provided to enable a quick warm-up without a fuel efficiency penalty.

Figure 2:
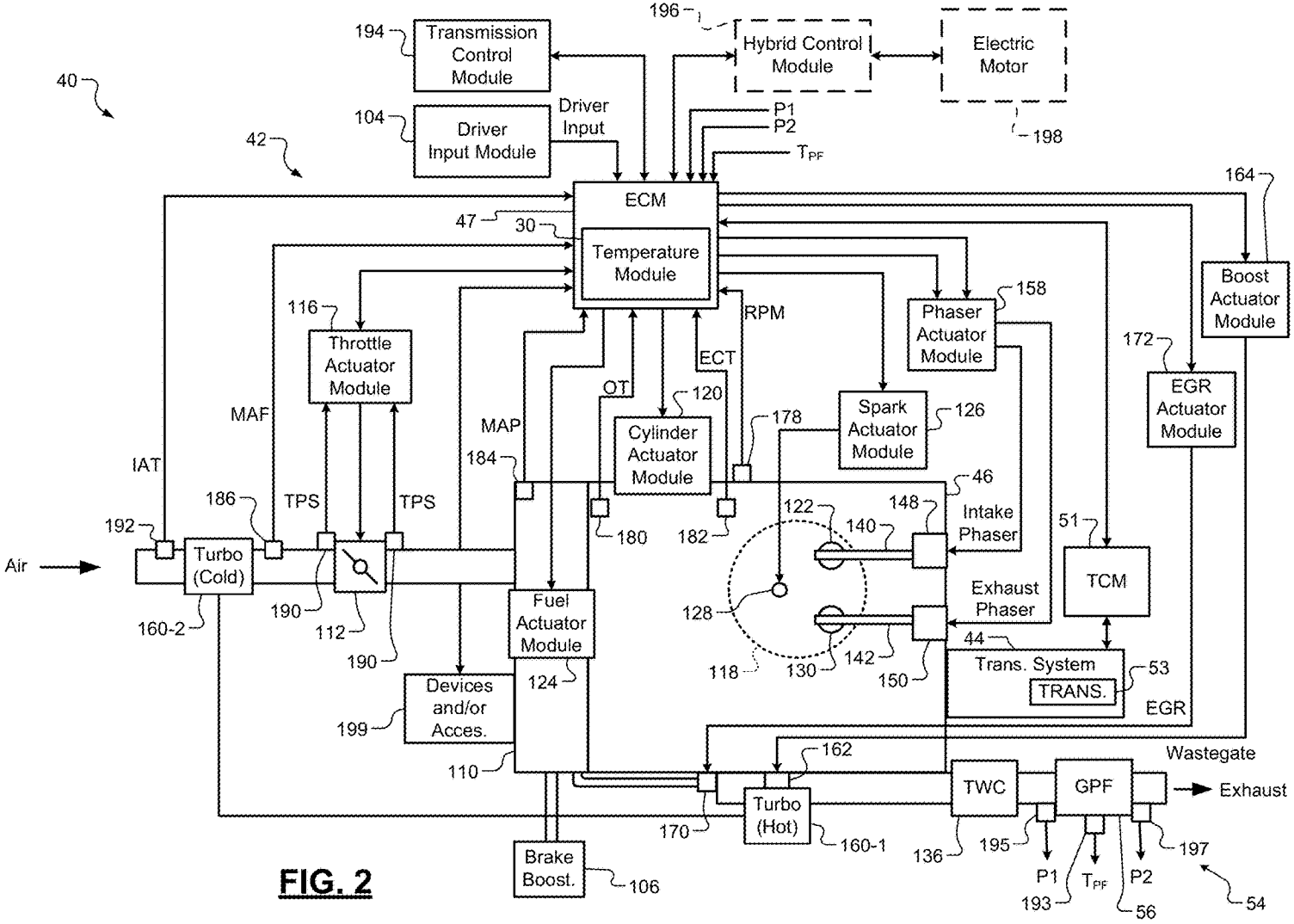
FIG. 2 is a functional block diagram of an example of a powertrain system incorporating a temperature module according to the present disclosure.

FIG. 2 shows a powertrain system 40 that includes an engine system 42 and a transmission system 44. The engine system 42 includes an engine 46 and an engine control module (ECM) 47. The transmission system 44 includes a transmission control module (TCM) 51 and a transmission 53. The ECM 47 includes a temperature module 50, which controls operating temperatures of the engine 46.

The powertrain system 40 includes the engine 46 that combusts an air/fuel mixture to produce drive torque for a vehicle based on a driver input from a driver input module 104. Air is drawn into an intake manifold 110 through a throttle valve 112. The ECM 47 controls a throttle actuator module 116, which regulates opening of the throttle valve 112 to control the amount of air drawn into the intake manifold 110. A brake booster 106 draws vacuum from the intake manifold 110 when the pressure within the intake manifold 110 is less (i.e., is a greater vacuum) than a pressure within the brake booster 106. The brake booster 106 assists a vehicle user in applying brakes of the vehicle.

Air from the intake manifold 110 is drawn into cylinders (one is shown) of the engine 46. The ECM 47 may instruct a cylinder actuator module 120 to selectively deactivate some of the cylinders (e.g., cylinder 118), which may improve fuel economy under certain engine operating conditions. During an intake stroke, air from the intake manifold 110 is drawn into the cylinder 118 through an intake valve 122. The ECM 47 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. Based on a signal from the ECM 47, a spark actuator module 126 energizes a spark plug 128 in the cylinder 118, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

During the combustion stroke, the combustion of the air/fuel mixture drives the piston down, thereby driving the crankshaft. During the exhaust stroke, the piston begins moving up from bottom dead center (BDC) and expels the byproducts of combustion through an exhaust valve 130. The byproducts of combustion are exhausted from the vehicle via an exhaust system 54.

The exhaust system 54 includes a catalyst 136 and a particulate filter 56. A catalyst 136 receives exhaust gas output by the engine 46 and reacts with various components of the exhaust gas. For example only, the catalyst may include a three-way catalyst (TWC), a catalytic converter, or another suitable exhaust catalyst. The particulate filter 56 may be downstream from the catalyst 136 and filters soot from an exhaust gas received from the catalyst 136.

The intake valve 122 may be controlled by an intake camshaft 140, while the exhaust valve 130 may be controlled by an exhaust camshaft 142. The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as electromagnetic actuators.

The times at which the intake and exhaust valves 122, 130 are opened may be varied with respect to piston TDC by intake and exhaust cam phasers 148, 150. A phaser actuator module 158 may control the intake and exhaust cam phasers 148, 150 based on signals from the ECM 47.

The powertrain system 40 may include a boost device that provides pressurized air to the intake manifold 110. For example, FIG. 1 shows a turbocharger including a hot turbine 160-1 that is powered by hot exhaust gases flowing through the exhaust system 54. The turbocharger also includes a cold air compressor 160-2, driven by the turbine 160-1, which compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 47 may control the turbocharger via a boost actuator module 164. The boost actuator module 164 may modulate the boost of the turbocharger by controlling the position of the wastegate 162.

The powertrain system 10 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The powertrain system 40 may measure the speed of the crankshaft (i.e., engine speed) in revolutions per minute (RPM) using an RPM sensor 178. Temperature of engine oil may be measured using an oil temperature (OT) sensor 180. Temperature of engine coolant may be measured using an engine coolant temperature (ECT) sensor 182. The ECT sensor 182 may be located within the engine 46 or at other locations where the coolant is circulated, such as a radiator (not shown). A temperature of the engine may be indicated as $T_{ENG}$. The temperature of the engine $T_{ENG}$ may be equal to or determined based on the engine oil temperature and/or the engine coolant temperature.

The pressure within the intake manifold 110 may be measured using a manifold absolute pressure (MAP) sensor 184. The mass flow rate of air flowing into the intake manifold 110 may be measured using a mass air flowrate (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 16 may be measured using an intake air temperature (IAT) sensor 192. The ECM 47 may use signals from one or more of the sensors to make control decisions for the powertrain system 40.

The ECM 47 may communicate with the TCM 51 to coordinate shifting gears (and more specifically gear ratio) in a transmission (not shown). For example, the ECM 47 may reduce engine torque during a gear shift. The ECM 47 may communicate with a hybrid control module 196 to coordinate operation (i.e., torque output production) of the engine 46 and an electric motor 198.

The electric motor 198 may also function as a generator, and may be used to produce electrical energy for use by vehicle electrical systems and/or for storage in an energy storage device (e.g., a battery). The production of electrical energy may be referred to as regenerative braking. The electric motor 198 may apply a braking (i.e., negative) torque on the engine 46 to perform regenerative braking and produce electrical energy. The powertrain system 40 may also include one or more additional electric motors. In various implementations, various functions of the ECM 47, the TCM 51, and the hybrid control module 196 may be integrated into one or more modules.

Each system that varies an engine parameter may be referred to as an engine actuator. Each engine actuator receives an associated actuator value. For example, the throttle actuator module 116 may be referred to as an engine actuator and the throttle opening area may be referred to as the associated actuator value. In the example of FIG. 2, the throttle actuator module 116 achieves the throttle opening area by adjusting an angle of the blade of the throttle valve 112.

Similarly, the spark actuator module 126 may be referred to as an engine actuator, while the associated actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these engine actuators, the associated actuator values may include: a number of activated cylinders; a fueling rate; intake and exhaust cam phaser angles; a boost pressure; and an EGR valve opening area. The ECM 47 may control actuator values in order to cause the engine 46 to generate a desired engine output torque.

The powertrain system 40 may further include one or more devices and/or accessories 199 that engage with and/or provide a load on the engine 46. The devices and/or accessories may include an air-conditioning system, compressor and/or clutch, an alternator, a generator, a cooling fan, etc. The ECM 47 may control operation of the device and/or accessories 199.

The engine system 42 may further include any number of temperature and/or pressure sensors on the exhaust system 54 for detecting temperatures and/or pressures of exhaust gas, temperatures of the catalyst 136, temperatures of the particulate filter 56, and/or pressures in and out of the catalyst 136 and/or the particulate filter 56. A temperature sensor 193 is shown for detecting a temperature $T_{PF}$ of the particulate filter 56. Pressure sensors 195, 197 are shown for detecting inlet and outlet pressures P1 and P2 of the particulate filter 56.

Figure 3:
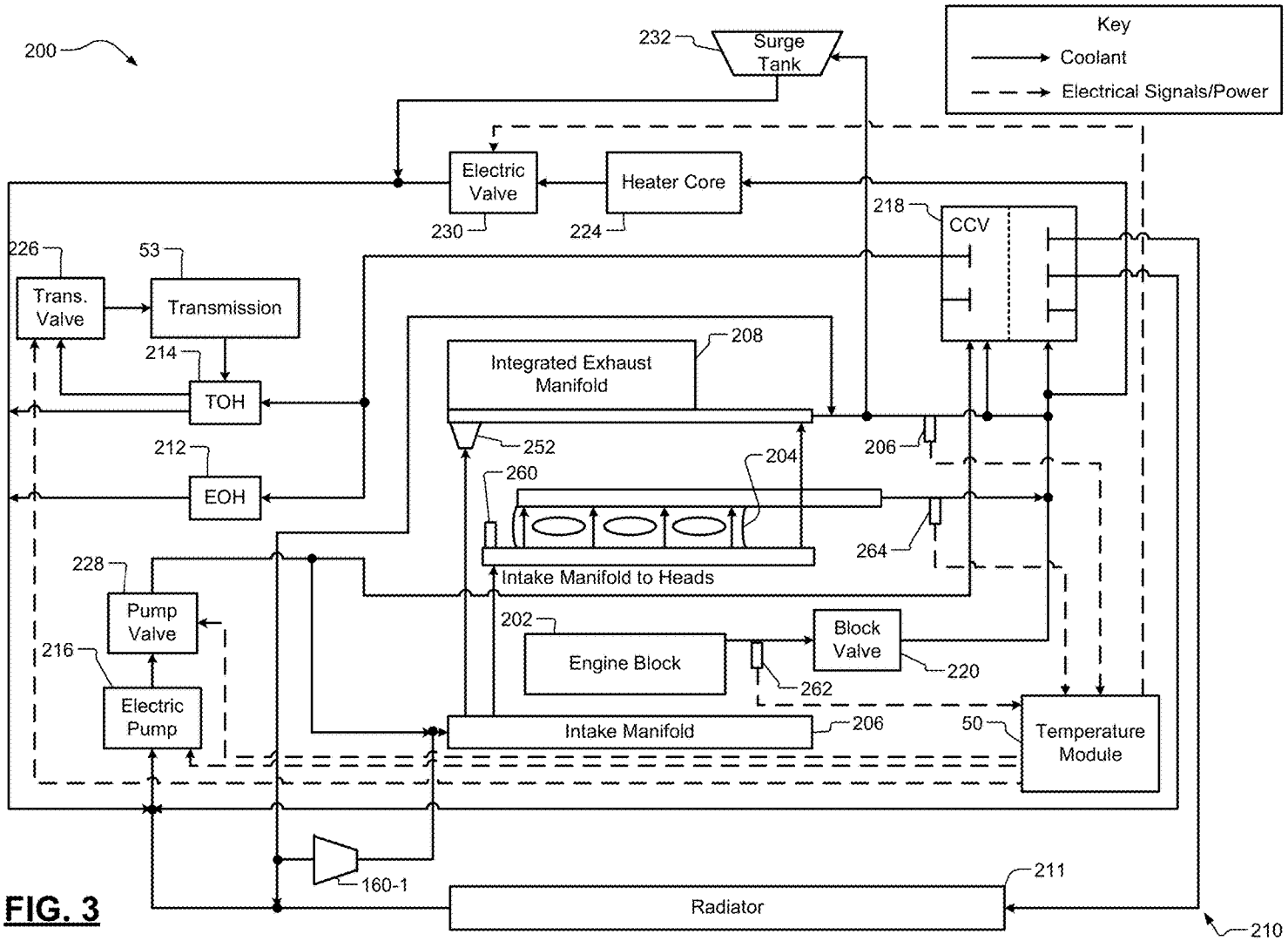
FIG. 3 is a functional block diagram of an example of an engine system and corresponding temperature control system incorporating the temperature module according to the present disclosure.

Referring now also to FIG. 3, which shows a representative example portion 200 of the engine system 42 of FIG. 1, which may be referred to as a temperature control system. The temperature control system 200 includes the engine 46, the temperature module 50, the transmission 53, and the turbine 160-1. The engine 46 includes an engine block 202, one or more cylinder heads (a single head 204 is shown), an intake manifold 206, and an integrated exhaust manifold (IEM) 208. The engine block 202, cylinder heads, and the IEM 208 are cooled by a coolant circulating through channels of conduits of a coolant flow circuit 210 and between (i) a radiator 211 and (ii) the engine block 202, the cylinder heads, and the IEM 208. The engine block 202, the cylinder heads, and the IEM 208 have respective coolant jackets (or coolant channels). The engine block 202 and transmission 53 may also be heated respectively via an engine oil heater (EOH) 212 and a transmission oil heater (TOH) 214. Oil may be circulated between (i) the engine 46 and the transmission 53 and (ii) the oil heaters 212, 214.

The temperature control system 200 may further include an electric pump 216, a coolant control valve (CCV) 218, a block valve 220, a heater core 224, a transmission valve 226, a pump valve 228, a core valve 230, and a surge tank 232. Although an electric pump 216 is shown, the electric pump 216 may be replaced with a manual pump that operates off of the engine 46. The CCV 218 may include a first side and a second side having corresponding inputs and outputs. Coolant channels are provided (i) between an input of the second side of the CCV 218 and an output of the IEM 208, an output of the head 204, and an output of the block valve 220, (ii) between an output of the second side of the CCV 218 and an input of the radiator 211, (iii) between an output of the second side of the CCV 218 and an input of the electric pump 216, and (iv) between an output of the first side of the CCV 218 and inputs of the EOH 212 and the TOH 214. Coolant channels are also provided (i) between the output of the IEM 208 and an input of the first side of the CCV 218 and an input of the surge tank 232, (ii) between an input of the heater core 224 and the outputs of the IEM 208, the head 204, and the block valve 220, (iii) between an output of the electric pump 216 and an input of the pump valve 228, and (iv) between an output of the pump valve 228 and an input of the intake manifold 206.

Coolant channels are also provided (i) between an output of the heater core 224 and an input of the core valve 230, (ii) between an output of the core valve 230 and outputs of the EOH 212 and the TOH 214, and (iii) between the output of the core valve 230 and the input of the electric pump 216. Coolant channels are also provided (i) between an output of the TOH 214 and the transmission valve 226, and (ii) between an output of the transmission valve 226 and an input of the transmission 53. Coolant channels are also provided (i) between an output of the turbine 160-1 and the output of the IEM 208, the inputs of the first and second sides of the CCV 218, and the input of the electric pump 216, and (ii) between an input of the turbine 160-1 and the intake manifold 206. The heater core 224 may be implemented as a heat exchanger and restricts flow of coolant. The coolant channel between the second side of the CCV 218 and the electric pump 216 is referred to as a bypass channel 250 that bypasses the radiator 211.

During operation, coolant flows out of the electric pump 216, may be restricted by the pump valve 228 and is provided to the intake manifold 206. The coolant is passed from the intake manifold 206 to the heads, the engine block 202, and an inlet 252 of the IEM 208. During a startup period, the CCV 218 may be partially or fully closed and a significant portion of the coolant may be passed around the CCV 218 to the heater core 224. During normal operation (i.e. periods of time outside of the cold startup period), coolant may be passed through the CCV 218 to the radiator 211, the electric pump 216 and/or the EOH 212 and the TOH 214.

The temperature control system 200 includes the temperature module 50, which controls temperatures of the coolant entering and exiting the engine 46. This includes temperatures of coolant entering and exiting the heads, the engine block 202 and the IEM 208. This temperature control may be based on signals from various sensors and/or various parameters. As shown, the temperature control system 200 includes temperature sensors 260, 262, 264, 266, which detect coolant temperatures of coolant out of the radiator $T_{RAD}$, out of the engine block 202 $T_{BLK}$, out of the head 204 $T_{HEAD}$, and out of the IEM 208 $T_{IEM}$. The sensors 260, 262, 264, 266 may be connected to respective ones of the conduits. The temperature module 50 controls operation of the electric pump 216 and the valves 228, 220, 226, 230 based on the signals and parameters (e.g., the temperatures $T_{RAD}$, $T_{BLK}$, $T_{HEAD}$, $T_{IEM}$).

Figure 4:
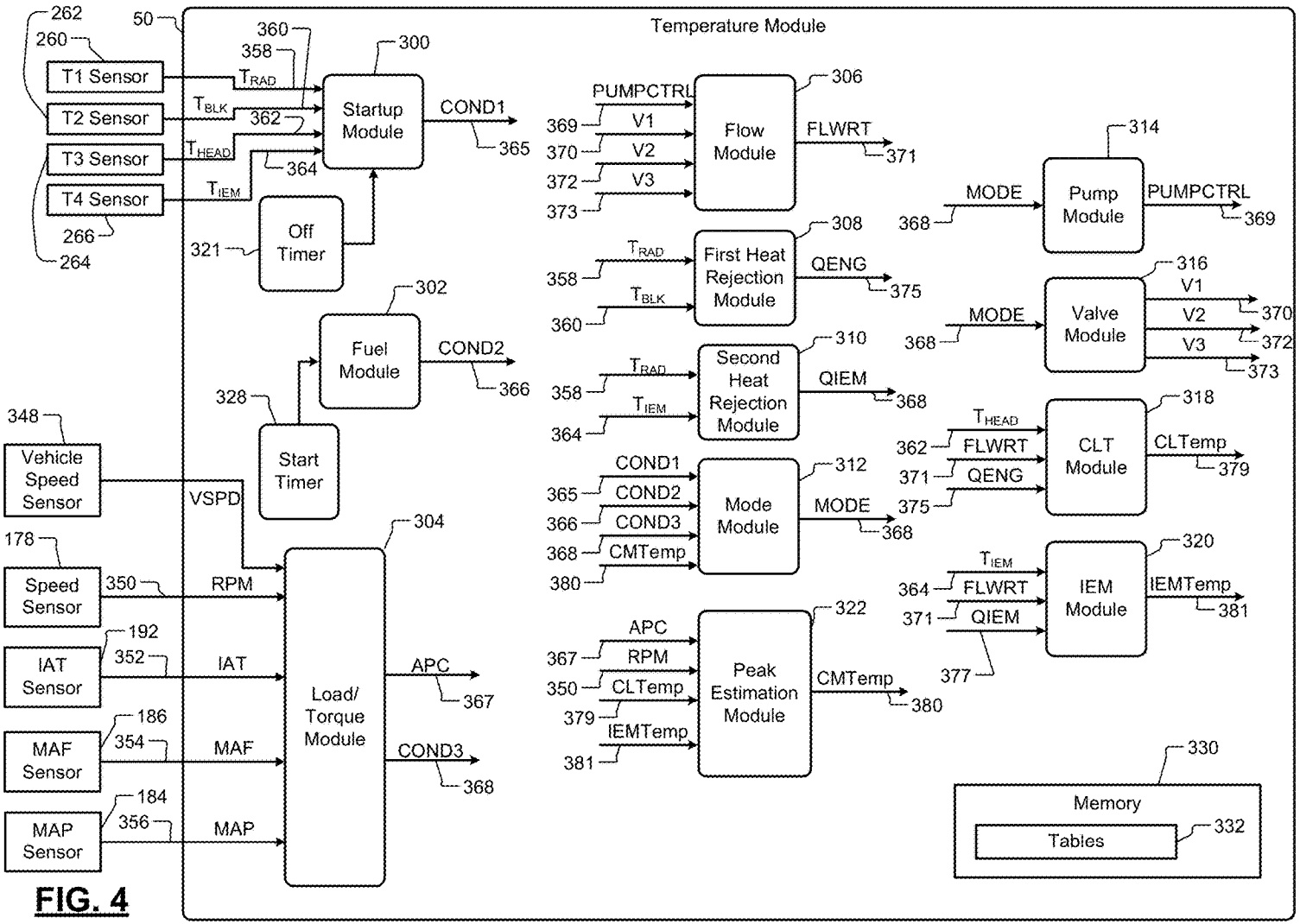
FIG. 4 is a functional block diagram of an example of the temperature module of FIGS. 2-3.

Referring now also to FIG. 4, which shows the temperature module 50, which includes a startup module 300, a fuel module 302, a load module 304, a flow rate module 306, a first heat rejection module 308, a second heat rejection module 310, a mode module 312, a pump module 314, a valve module 316, a CLT module 318, an IEM module 320, and a peak estimation module 322 (may be referred to as the "critical metal module"). The temperature module 50 may further include an off timer 326, a start timer 328 and a memory 330. The modules 50, 300, 302 may receive signals from various sensors, such as from the sensors 178, 184, 186, 192, 260, 262, 264, 266. For further defined structure of the modules of FIGS. 2-4 see below provided method of FIG. 5 and below provided definition for the term "module".

The memory 330 may store one or more tables 332 for each of the modules 50, 300, 302, 304, 306, 308, 310, 312, 314, 316, 318, 320, 322. As an alternative, the memory 330 may be external to the temperature module 50 and may be accessed by the temperature module 50. The memory 330 may store maps, tables, algorithms, etc. used by the modules 50, 300, 302, 304, 306, 308, 310, 312, 314, 316, 318, 320, 322. As an example, the memory 330 may store tables for relating and determining parameters output from the modules 50, 300, 302, 304, 306, 308, 310, 312, 314, 316, 318, 320, 322 to input parameters received by the modules 50, 300, 302, 304, 306, 308, 310, 312, 314, 316, 318, 320, 322. These relationships are further described below.

Figure 5:
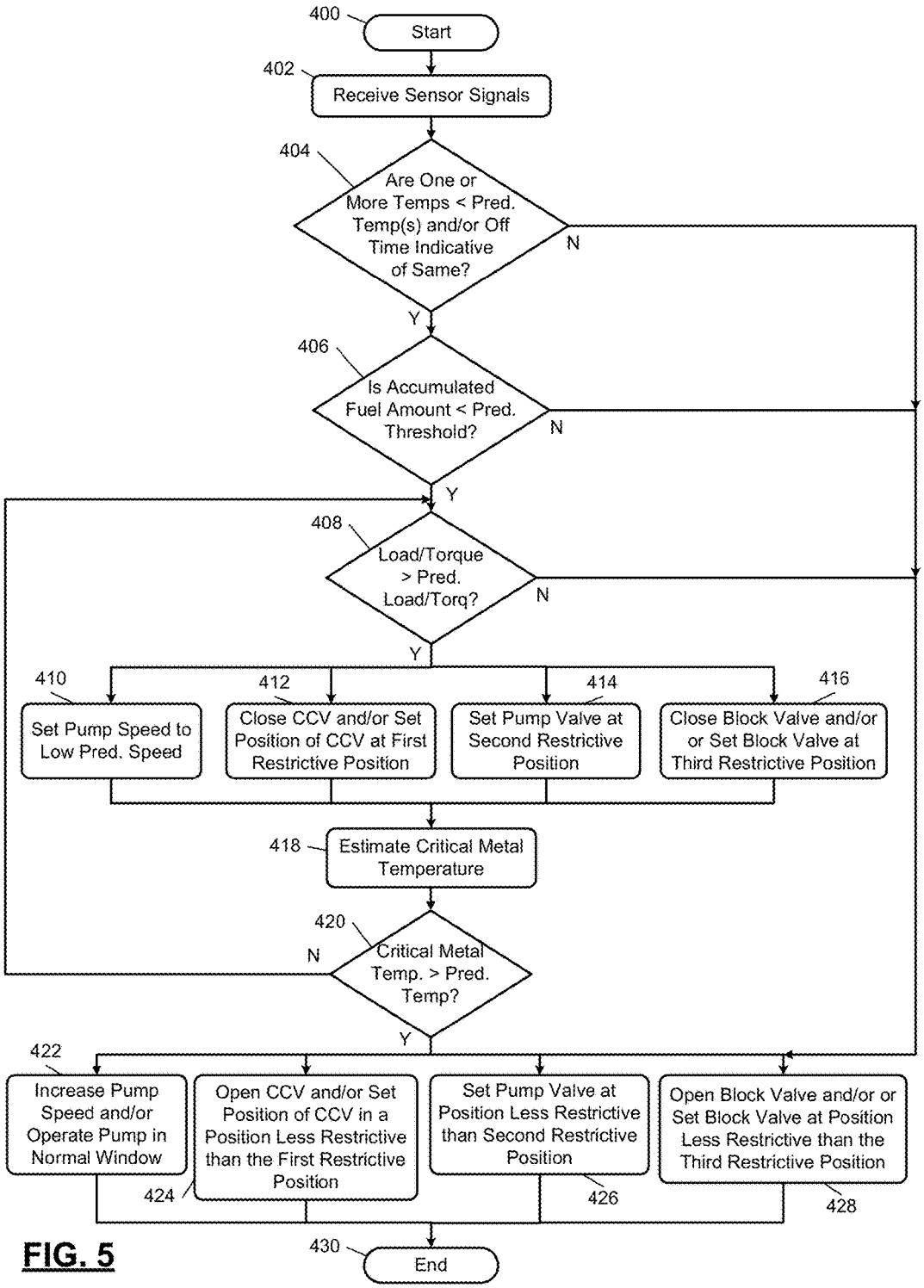
FIG. 5 is a flow diagram illustrating a temperature control method for coolant of an engine according to the present disclosure.

The systems disclosed herein may be operated using numerous methods. An example method is illustrated in FIG. 5. In FIG. 5, a temperature control method is shown. Although the following tasks are primarily described with respect to the implementations of FIGS. 2-4, the tasks may be easily modified to apply to other implementations of the present disclosure. The tasks may be iteratively performed. Each of the following tasks may be performed by the temperature module 50 and/or by one or more of the modules 300, 302, 304, 306, 308, 310, 312, 314, 316, 318, 320, 322.

The method may begin at 400. At 402, the temperature module 50 receives signals from the sensors 178, 184, 186, 192, 260, 262, 264, 266 and/or other sensors (e.g., a vehicle speed sensor 348). The signals are indicative of an engine speed RPM (350), an intake air temperature IAT (352), a mass air flow MAF (354), a manifold absolute pressure MAP (356), a vehicle speed VSPD (349), a coolant intake manifold temperature $T_{RAD}$ (358), a coolant engine temperature $T_{ENG}$ (360), a coolant head temperature $T_{HEAD}$ (362), and a coolant IEM temperature $T_{IEM}$ (364).

At 404, the startup module 300 determines whether a cold startup of the engine 46 is being performed by determining whether one or more of the temperatures $T_{RAD}$, $T_{BLK}$, $T_{HEAD}$, $T_{IEM}$ is less than respective predetermined temperatures and/or if the engine has been OFF for more than a predetermined period. The startup module 300 generates a first condition signal COND1 (365) based on this determination. The OFF timer 324 indicates an amount of time the engine has been OFF. This allows the startup module 300 to determine whether a cold start is being performed. This determination may be performed based on (or in response to) a startup of the engine (e.g., fuel and ignition enabled), a key-ON start of the engine, a push-button start of the engine, etc. As an example, the startup module 300 may determine whether the head temperature $T_{HEAD}$ is less than a predetermined temperature (e.g., 140° C., 120° C., 110° C., 100° C.). If a cold startup is being performed, task 406 is performed, otherwise the method may end at 430, return to task 402, or perform one or more of tasks 422, 424, 426, 428 as shown.

At 406, the fuel module 302 may determine a total amount of fuel provided to the engine 46 since a last startup of the engine 46. The total amount of fuel is an accumulation of the fuel provided to each of the cylinders since the last startup of the engine 46. This determination may be performed based on a start time and/or an amount of time since the last startup. The start time and/or the amount of time since the last startup may be provided via the start timer 328. The fuel module 302 determines whether the total amount of fuel is greater than a predetermined amount of fuel and generates a second condition signal COND2 (366). If the second condition signal COND2 is TRUE, task 408 may be performed, otherwise the method may end at 430, return to task 402, or perform one or more of tasks 422, 424, 426, 428 as shown. In one embodiment, task 406 is skipped and task 408 is performed after task 406.

At 408, the load module 304 determines whether a load on the engine 46 and/or the transmission 53 and/or an amount of torque output from the engine 46 and/or the transmission 53 are less than corresponding predetermined thresholds. The load module 304 may determine the load on the engine 46 and/or the transmission 53 and/or the amount of torque output from the engine 46 and/or the transmission 53 based on the signals RPM, IAT, MAF, MAP, VSPD, a pump control signal PUMPCTRL, and/or other signals and/or parameters that affect the load and/or torque values determined. The PUMPCTRL signal may be generated at, for example, task 410 to control the speed of the electric pump 216. The load module 304 may determine an air per cylinder (APC) (367), which may be used to determine the load and/or torque values. The load module 304 generates a third condition signal COND3 (368), which indicates whether the load on the engine 46 and/or the transmission 53 and/or the amount of torque output from the engine 46 and/or the transmission 53 are less than corresponding predetermined thresholds. If the third condition signal COND3 is TRUE, one or more of tasks 410, 412, 414, 416 may be performed, otherwise the method may end at 430, return to task 402, or perform one or more of tasks 422, 424, 426, 428 as shown.

Based on the condition signals COND1, COND2, and COND3, the mode module 312 generates a mode signal MODE (368) indicating whether a cold startup process is being performed. For example, if each of the conditions COND1, COND2, COND3, is TRUE, the mode signal MODE may indicate a cold startup process is being performed. The mode signal MODE, may also be generated based on a critical metal temperature CMTemp (380), which is estimated by the peak estimation module 322 at 418. Although the peak estimation module 322 is primarily described as estimating a temperature of a hottest metal location on the engine 46, the peak estimation module 322 may determine a temperature of a hottest non-metal location on the engine 46. Thus, the CMTemp may indicate a hottest non-metal temperature on the engine 46. The mode module 312 may transition from operating in a cold startup mode during a cold startup period to operating in a post startup mode at the end of the cold startup period. This may occur when the critical metal temperature CMTemp is greater than a predetermined critical metal (or non-metal) temperature. The critical metal temperature CMTemp may refer to a temperature of a hottest point on the engine 46, such as a point on the head 204, a point between the head 204 and the IEM 208, a point on an exhaust bridge on the head 204, a point on the IEM 208, or some other point on the engine 46.

At 410, the pump module 314 based on the mode signal MODE generates the pump control signal PUMPCTRL (369) to operate the pump 216 at a predetermined speed to circulate coolant. The predetermined speed may be a minimum operating speed of the pump. As an example, the pump 216 may have an operating range of 300-6000 revolutions per minute (RPM). The predetermined speed may be 300 RPM or a speed less than 400 RPM.

At 412, the valve module 316, based on the mode signal MODE, may partially or fully close the CCV 218. If operating in the cold startup mode, the CCV 218 may be partially or fully closed. In one embodiment, the CCV 218 is fully closed. This aids in restricting flow of the coolant and diverts a large portion of the coolant to the heater core 224, which also restricts the flow of the coolant. This minimizes coolant flow to the radiator 211 and to the bypass 250. A first valve signal V1 (370) is generated to control the position of the CCV 218. The position of the CCV 218 may be based on the mode signal MODE, one or more of the temperatures $T_{RAD}$, $T_{BLK}$, $T_{READ}$, $T_{IEM}$, a flow rate FLWRT (371) of the coolant as determined at 418, and/or one or more of the other parameters determined by the modules 300, 302, 304, 306, 308, 310, 312, 314, 316, 318, 320, 322, as disclosed herein.

At 414, the valve module 316, based on the mode signal MODE, may partially close the pump valve 228 to further restrict flow of the coolant. If operating in the cold startup mode, the pump valve 228 may be partially closed or left fully open. In one embodiment, the pump valve 228 is left fully open. A second valve signal V2 (372) is generated to control the position of the pump valve 228. The position of the pump valve 228 may be based on the mode signal MODE, one or more of the temperatures $T_{RAD}$, $T_{BLK}$, $T_{HEAD}$, $T_{IEM}$, the flow rate FLWRT, and/or one or more of the other parameters determined by the modules 300, 302, 304, 306, 308, 310, 312, 314, 316, 318, 320, 322, as disclosed herein. At 416, the valve module 316, based on the mode signal MODE, may partially or fully close the block valve 220. If operating in the cold startup mode, the block valve 220 may be partially or fully closed. In one embodiment, the block valve 220 is fully closed. A third valve signal V3 (373) is generated to control the position of the block valve 220. The position of the block valve 220 may be based on the mode signal MODE, one or more of the temperatures $T_{RAD}$, $T_{BLK}$, $T_{HEAD}$, $T_{IEM}$, the flow rate FLWRT, and/or one or more of the other parameters determined by the modules 300, 302, 304, 306, 308, 310, 312, 314, 316, 318, 320, 322, as disclosed herein.

Figure 6:
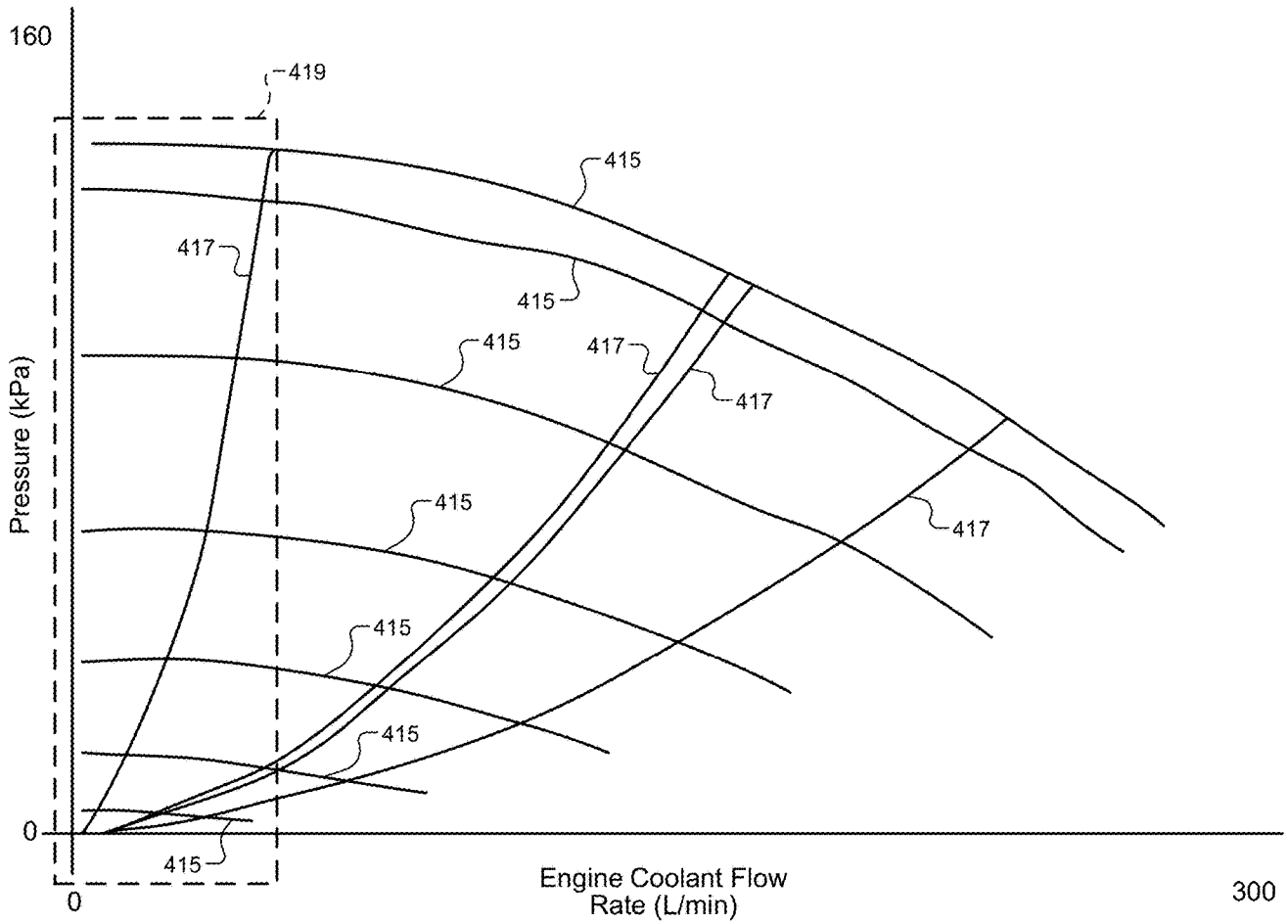
FIG. 6 is a pressure versus flow rate plot indicating an example operating range for the temperature module of FIGS. 2-4.

Tasks 410, 412, 414, 416 may be performed to restrict coolant flow and provide a flow rate that is less than a predetermined flow rate to maximize and/or maintain a predetermined level of fuel efficiency. The restriction allows thermal energy to be transferred to quickly heat up the head 204 and the IEM 208. FIG. 6 shows a pressure versus engine coolant flow rate plot that includes (i) pressure versus engine coolant flow rate curves 415 for different engine loads, and (ii) pressure versus engine coolant flow rate curves 417 for different amounts of coolant flow restriction. A dashed box 419 indicates an area of the plot and a corresponding operating range in which fuel efficiency is maximized due to low engine coolant flow rates. The temperature module 50 may operate in this range during the cold startup period.

At 418, the critical metal temperature CMTemp is estimated. The flow module 306 determines the flow rate FLWRT based on a speed of the pump 216, positions of one or more of the valves 218, 220, 226, 230. The speed of the pump 216 may be indicated by the pump control signal PUMPCTRL. One of the tables 332 may relate flow rates to speeds of the pump 216 and positions of the valves, 218, 220, 226, 230.

The first heat rejection module 308 estimates an amount of heat rejection QENG (375) of the engine 46 based on the temperatures $T_{RAD}$, $T_{BLK}$. The amount of heat rejection QENG may be determined based on equation 1, where $\dot{Q}$ is replaced with QENG, $\dot{m}$ is the coolant flow rate FLWRT of the engine 46 (or engine block 202), c is a heat constant, and $\Delta t$ is a difference in temperature across the engine 46. The difference in temperature $\Delta t$ may be determined based on and/or a difference between the temperatures $T_{RAD}$, $T_{BLK}$. The heat rejection energy QENG is a function of torque output of the engine 46 and the speed RPM of the engine 46.

$$\dot{Q}=\dot{m}c\Delta t \tag{1}$$

The second heat rejection module 310 estimates an amount of heat rejection QIEM (377) of the IEM 208 based on the temperatures $T_{RAD}$, $T_{IEM}$. The amount of heat rejection QIEM may be determined based on equation 1, where $\dot{Q}$ is replaced with QIEM, $\dot{m}$ is the coolant flow rate FLWRT of the engine 46 (or IEM 208), and $\Delta t$ is a difference in temperature across the IEM 208. The difference in temperature $\Delta t$ may be determined based on and/or a difference between the temperatures $T_{RAD}$, $T_{IEM}$. The heat rejection energy QENG is a function of torque output of the engine 46 and the speed RPM of the engine 46.

The coolant module 318 estimates a temperature of the coolant CLTemp (379) based on the detected temperature $T_{HEAD}$, the flow rate FLWRT, and the amount of heat rejection QENG. The temperature of the coolant CLTemp may be an actual coolant temperature in the head 204. As with the other parameters determined during this method, the temperature of the coolant CLTemp may be determined using a corresponding table. The table for CLTemp may relate actual temperatures of the coolant through the head 204 to detected temperatures provided via the sensor 264, coolant flow rates, and amounts of heat rejection of the engine 46. The detected temperature provided by the sensor 264 is a delayed temperature for the actual temperature of the coolant in the head 204. Thus, the estimate of the temperature of the coolant CLTemp may be referred to as a delayed estimate. The amount of delay is based on the coolant flow rate FLWRT.

The IEM module 320 estimates a temperature of the IEM 208 (or a temperature of the coolant passing through the IEM 208) IEMTemp (381) based on the temperature $T_{IEM}$, the flow rate FLWRT and the amount of heat rejection of the IEM 208. The temperature of the IEM 208 IEMTemp may be determined using a corresponding table. The table for IEMTemp may relate actual temperatures of the IEM 208 to detected temperatures of the IEM 208 detected by the sensor 266, coolant flow rates and amounts of heat rejection of the IEM 208. The detected temperature provided by the sensor 266 is a delayed temperature for the actual temperature of the IEM 208. Thus, the estimate of the temperature of the IEM 208 IEMTemp may be referred to as a delayed estimate. The amount of delay is based on the coolant flow rate FLWRT.

The peak estimation module 322 estimates the critical metal temperature CMTemp based on the air per cylinder APC, the engine speed RPM, the coolant temperature CLTemp, and the temperature of the IEM 208 IEMTemp. The critical metal temperature CMTemp may be determined using a corresponding table relating critical metal temperatures to APCs, RPMs, coolant temperatures, and IEM temperatures.

At 420, the mode module 312 determines whether to transition from the cold startup mode to the post cold startup mode based on the critical metal temperature CMTemp. If the critical metal temperature CMTemp is greater than or equal to the predetermined critical metal (or non-metal) temperature, one or more of tasks 422, 424, 426, 428 may be performed. If the critical metal temperature CMTemp is less than the predetermined critical metal (or non-metal) temperature, task 408 may be performed.

At 422, pump module 314, based on the mode signal MODE may increase the speed of the pump 216 and/or operate the pump 216 within a normal operating window. The normal operating window may include pump speeds greater than the pump speeds implemented during the cold startup mode.

At 424, the valve module 316 may partially or fully open the CCV 218. The valve module 316 may change the position of the CCV 218 to be in a less restrictive position than the position implemented during the cold startup mode. At 426, the valve module 316 may increase an opening of and/or fully open the pump valve 228. The valve module 316 may change the position of the pump valve 228 to be in a less restrictive position than the position implemented during the cold startup mode. At 428, the valve module 316 may partially or fully open the block valve 220. The valve module 316 may change the position of the block valve 220 to be in a less restrictive position than the position implemented during the cold startup mode. Subsequent to tasks 422, 424, 426, 428, the method may end as shown at 430 or return to task 402.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events. For example, tasks 404, 406, and 408 may be performed in a different order. As another example, tasks 404 or 406 may be performed instead of task 408 if the critical metal temperature is greater than or equal to the predetermined critical metal (or non-metal) temperature at task 420.

The above-described examples include operating a pump and/or positioning one or more valves to provide a low coolant flow rate during a cold startup period of an engine. Slowly moving coolant away from engine hot spots (areas of the engine that are hotter than adjacent areas of the engine) during warm-up improves engine warm-up robustness without impacting fuel efficiency. The disclosed examples use time delayed coolant sensor feedback while providing the low coolant flow rate to assist in estimating and/or predicting temperatures of a critical metal point on the engine. The disclosed example may reduce calibration time of a temperature control system. The utilized feedback information may reduce erosion of metal of an engine previously associated with coolant boiling in traditional systems.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising: a startup module configured to (i) during a startup period of an engine or in response to a startup of the engine, receive a temperature signal from a first temperature sensor, and (ii) generate a first condition signal based on the temperature signal; a load module configured to (i) determine a load on the engine, and (ii) generate a second condition signal; a flow module configured to, if the first condition signal indicates a temperature of the engine is less than a first predetermined temperature and if the second condition signal indicates the load is less than a predetermined threshold, operate a pump to circulate coolant through an engine block of the engine during a cold start of the engine, wherein, during the startup period, if the temperature of the engine is less than the first predetermined temperature, then the engine is experiencing the cold start; and a peak estimation module configured to estimate a temperature of a hottest metal location on the engine during a current period of time and independent of at least one of the temperature of the engine indicated by the first condition signal or a location of the hottest metal location, wherein the flow module is configured to increase a speed of the pump if (i) the temperature of the hottest metal location is greater than a second predetermined temperature, or (ii) the load is greater than or equal to the predetermined threshold.

2. The system of claim 1, wherein the speed of the pump is a minimum speed of the pump and is greater than zero.

3. The system of claim 1, further comprising a valve module configured to, if the first condition signal indicates the temperature of the engine is less than the first predetermined temperature and if the second condition signal indicates the load is less than the predetermined threshold, partially or fully close a coolant control valve, a block valve or a pump valve to restrict flow of the coolant.

4. The system of claim 1, further comprising a valve module configured to, if the first condition signal indicates the temperature of the engine is less than the first predetermined temperature and if the second condition signal indicates the load is less than the predetermined threshold, restrict flow of the coolant by (i) fully closing a coolant control valve, (ii) fully closing a block valve, and (iii) partially closing a pump valve.

5. The system of claim 1, wherein the flow module is configured to increase a speed of the pump if (i) the temperature of the hottest metal location is greater than the second predetermined temperature, and (ii) the load is greater than or equal to the predetermined threshold.

6. The system of claim 1, further comprising:

a heat rejection module configured to determine an amount of heat rejection of the engine; and a coolant module configured to estimate a temperature of the coolant based on (i) the amount of heat rejection of the engine, (ii) a flow rate of the coolant, and (iii) the temperature signal or another temperature signal from another temperature sensor, wherein the peak estimation module is configured to estimate the temperature of the hottest metal location on the engine based on the estimated temperature of the coolant.

7. The system of claim 1, further comprising:

a heat rejection module configured to determine an amount of heat rejection of an integrated exhaust manifold of the engine; and a manifold module configured to estimate a temperature of the coolant based on (i) the amount of heat rejection of the integrated exhaust manifold, (ii) a flow rate of the coolant, and (iii) another temperature signal from another temperature sensor, wherein the peak estimation module is configured to estimate the temperature of the hottest metal location on the engine based on the estimated temperature of the coolant.

8. The system of claim 1, further comprising:

a first heat rejection module configured to determine an amount of heat rejection of the engine;

a second heat rejection module configured to determine an amount of heat rejection of an integrated exhaust manifold of the engine; and a coolant module configured to estimate a temperature of the coolant based on (i) the amount of heat rejection of the engine, (ii) a flow rate of the coolant, and (iii) the temperature signal or a second temperature signal from a second temperature sensor; and a manifold module configured to estimate a temperature of the coolant based on (i) the amount of heat rejection of the integrated exhaust manifold, (ii) the flow rate of the coolant, and (iii) the second temperature signal or a third temperature signal from a third temperature sensor, wherein the peak estimation module is configured to estimate the temperature of the hottest metal location on the engine based on the estimated temperature of the coolant and the estimated temperature of the integrated exhaust manifold.

9. The system of claim 8, wherein the peak estimation module is configured to estimate the temperature of the hottest metal location on the engine based on an air per cylinder of the engine and a speed of the engine.

10. A system comprising: a startup module configured to (i) during a startup period of an engine or in response to a startup of the engine, receive a temperature signal from a first temperature sensor, and (ii) generate a first condition signal based on the temperature signal; a load module configured to (i) determine an amount of output torque of on the engine, and (ii) generate a second condition signal; a flow module configured to, if the first condition signal indicates a temperature of the engine is less than a first predetermined temperature and if the second condition signal indicates the amount of output torque is less than a predetermined threshold, operate a pump to circulate coolant through an engine block of the engine during a cold start of the engine, wherein, during the startup period, if the temperature of the engine is less than the first predetermined temperature, then the engine is experiencing the cold start; and a peak estimation module configured to estimate a temperature of a hottest metal location on the engine during a current period of time and independent of at least one of the temperature of the engine indicated by the first condition signal or a location of the hottest metal location, wherein the flow module is configured to increase a speed of the pump if (i) the temperature of the hottest metal location is greater than a second predetermined temperature, or (ii) the amount of output torque is greater than or equal to the predetermined threshold.

11. The system of claim 10, further comprising a valve module configured to, if the first condition signal indicates the temperature of the engine is less than the first predetermined temperature and if the second condition signal indicates the load is less than the predetermined threshold, partially or fully close a coolant control valve, a block valve or a pump valve to restrict flow of the coolant.

12. The system of claim 10, further comprising a valve module configured to, if the first condition signal indicates the temperature of the engine is less than the first predetermined temperature and if the second condition signal indicates the load is less than the predetermined threshold, restrict flow of the coolant by (i) fully closing a coolant control valve, (ii) fully closing a block valve, and (iii) partially closing a pump valve.

13. The system of claim 10, wherein the flow module is configured to increase a speed of the pump if (i) the temperature of the hottest metal location is greater than the second predetermined temperature, and (ii) the load is greater than or equal to the predetermined threshold.

14. The system of claim 10, further comprising:

a first heat rejection module configured to determine an amount of heat rejection of the engine;

a second heat rejection module configured to determine an amount of heat rejection of an integrated exhaust manifold of the engine; and a coolant module configured to estimate a temperature of the coolant based on (i) the amount of heat rejection of the engine, (ii) a flow rate of the coolant, and (iii) the temperature signal or a second temperature signal from a second temperature sensor; and a manifold module configured to estimate a temperature of the coolant based on (i) the amount of heat rejection of the integrated exhaust manifold, (ii) the flow rate of the coolant, and (iii) the second temperature signal or a third temperature signal from a third temperature sensor, wherein the peak estimation module is configured to estimate the temperature of the hottest metal location on the engine based on the estimated temperature of the coolant and the estimated temperature of the integrated exhaust manifold.

15. The system of claim 14, wherein the peak estimation module is configured to estimate the temperature of the hottest metal location on the engine based on an air per cylinder of the engine and a speed of the engine.

16. A method comprising: during a startup period of an engine or in response to a startup of the engine, receive a temperature signal from a first temperature sensor and generate a first condition signal based on the temperature signal; determining a load on the engine and generating a second condition signal based on the load; activating a pump to circulate coolant through an engine block of the engine during a cold start of the engine if the first condition signal indicates a temperature of the engine is less than a first predetermined temperature and if the second condition signal indicates the load is less than a predetermined threshold, wherein, during the startup period of the engine, if the temperature of the engine is less than the first predetermined temperature, then the engine is experiencing the cold start; estimating a temperature of a hottest metal location on the engine during a current period of time, wherein the estimated temperature of the hottest metal location is different than the temperature of the engine indicated by the first condition signal; and increasing a speed of the pump if (i) the temperature of the hottest metal location is greater than a second predetermined temperature, or (ii) the load is greater than or equal to the predetermined threshold.

17. The method of claim 16, further comprising, if the first condition signal indicates the temperature of the engine is less than the first predetermined temperature and if the second condition signal indicates the load is less than the predetermined threshold, partially or fully closing a coolant control valve, a block valve or a pump valve to restrict flow of the coolant.

18. The method of claim 16, further comprising, if the first condition signal indicates the temperature of the engine is less than the first predetermined temperature and if the second condition signal indicates the load is less than the predetermined threshold, restricting flow of the coolant by (i) fully closing a coolant control valve, (ii) fully closing a block valve, and (iii) partially closing a pump valve.

19. The method of claim 16, further comprising:

determining an amount of heat rejection of the engine;

determining an amount of heat rejection of an integrated exhaust manifold of the engine;

estimating a temperature of the coolant based on (i) the amount of heat rejection of the engine, (ii) a flow rate of the coolant, and (iii) the temperature signal or a second temperature signal from a second temperature sensor; and estimating a temperature of the coolant based on (i) the amount of heat rejection of the integrated exhaust manifold, (ii) the flow rate of the coolant, and (iii) the second temperature signal or a third temperature signal from a third temperature sensor, wherein the temperature of the hottest metal location on the engine is estimated based on the estimated temperature of the coolant and the estimated temperature of the integrated exhaust manifold.

20. The method of claim 19, comprising estimating the temperature of the hottest metal location on the engine based on an air per cylinder of the engine and a speed of the engine.

* * * * *